United States Patent [19]

Harvey et al.

[11] 4,188,745

[45] Feb. 19, 1980

[54] INFANT TOY

[76] Inventors: Phillip D. Harvey; Miden G. Harvey, both of 910 Peterson Ave., Wichita, Kans. 67212

[21] Appl. No.: 842,786

[22] Filed: Oct. 17, 1977

[51] Int. Cl.[2] ..... A63H 3/50

[52] U.S. Cl. ..... 46/32

[58] Field of Search ..... 46/1 R, 32; 248/106, 248/226 E

[56] References Cited

U.S. PATENT DOCUMENTS 1,436,367 11/1922 Sullivan ..... 46/32

4,034,945 7/1977 Sato ..... 248/106

*Primary Examiner*—Russell R. Kinsey
*Assistant Examiner*—Robert P. Swiatek
*Attorney, Agent, or Firm*—John H. Widdowson

[57] ABSTRACT

An infant toy for mounting on an infant seat, car seat, infant bed, stroller, or the like. The infant toy suspending play objects such as bells, mirrors, stars, or other attractable objects for the amusement of an infant. The infant toy adjustable for mounting on various sizes of infant seats, car seats, or other types of seats and beds used for holding an infant.

5 Claims, 4 Drawing Figures

INFANT TOY

BACKGROUND OF THE INVENTION

This invention relates generally to children's toys and more particularly, but not by way of limitation, to an infant toy for mounting on an infant seat, an infant bed, or the like.

Heretofore there have been various types of toy racks, high chair toys, baby and infant exercisers, and cradle toys. None of the prior art toys are adaptable for different types and designs of infant seats and infant beds and provide the novel structure as described herein.

SUMMARY OF THE INVENTION

The subject invention provides an infant toy which is adaptable for different types of infant seats, car seats, infant beds, or the like. The toy is simple in design, rugged in construction, and may be used safely with infants. The toy is made of light-weight plastic.

The infant toy is adapted for mounting on the sides of an infant seat or car seat and may be quickly removed and placed in an infant bed. The height and width of the toy are adjustable for proper positioning of the toy above the infant so that play objects may or may not be placed within the reach of the infant.

The toy suspends play objects such as bells, mirrors, stars, or any other attractable objects to the infant from coiled rubber springs attached to the top of the toy. The coiled rubber springs allow the play objects to be suspended above the infant, grabbed or hit by the infant, and returned to their original position for the amusement of the infant.

The infant toy includes a first inverted "L"-shaped tube having a horizontal arm and an elongated vertical arm and a second inverted "L"-shaped tube having a horizontal arm and an elongated vertical arm. The second tube is slidably attached to the first tube. A plurality of play objects are attached to coiled rubber springs suspended from the horizontal arms of the tubes. The toy includes a flat angular base having a pair of collars for receiving the ends of the vertical arms for holding the toy in an upright position in an infant bed. The toy also includes a pair of adjustable clamps which are slidably mounted on the elongated vertical arms for securing the toy to the sides of an infant seat or car seat.

The advantages and objects of the invention will become evident from the following detailed description when read in conjunction with the accompanying drawings which illustrate the preferred embodiments of the invention.

DETAILED DESCRIPTION OF THE DRAWINGS

Figure 1:
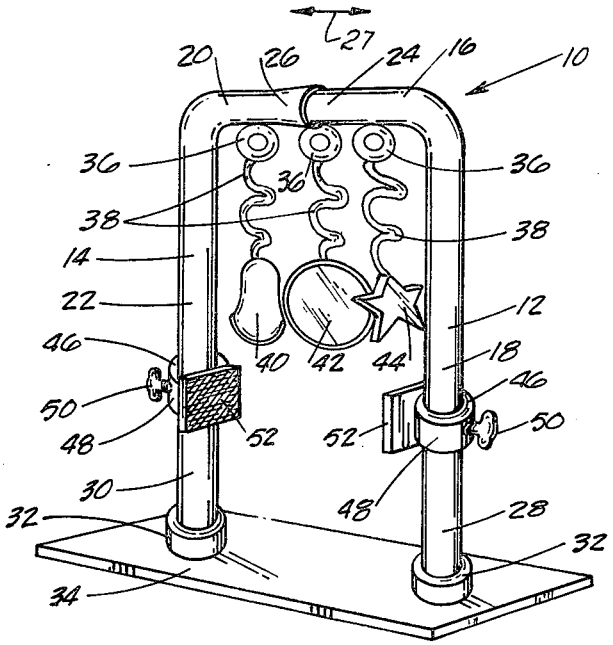
In FIG. 1, a perspective view of the infant toy is illustrated.

In FIG. 1, the infant toy is designated by general reference numeral 10. The toy 10 includes a first inverted "L"-shaped tube 12 and a second "L"-shaped inverted tube 14. The first tube 12 includes a horizontal arm 16 integrally attached to an elongated vertical arm 18. The second tube 14 also includes a horizontal arm 20 integrally attached to an elongated vertical arm 22. An end portion 24 of the arm 16 of the tube 12 is slidably received in an end portion 26 of the horizontal arm 20 of the second tube 14. By slidably adjusting the end 24 of the arm 16 in the end 26 of the arm 20, the width between the vertical arm 18 and vertical arm 22 may be adjusted. The width adjustment is indicated by arrow 27. An end portion 28 of the vertical arm 18 and an end portion 30 of the vertical arm 22 are slidably received in collars 32 mounted on top of a flat angular shaped base 34. The flat base 34 is used for holding the infant toy 10 in an upright position and is used when the toy 10 is placed inside an infant bed, playpen, stroller, or any similar type of infant bed.

The toy 10 includes a plurality of rings 36 attached to the bottom of the horzontal arms 16 and 20. The rings 36 are used for attaching one end of coiled rubber springs 38 which are similar to the telephone cord used on telephones. The springs 38 suspend a plurality of different types of play objects such as a bell 40, a mirror 42, and a star 44. These play objects are used for attracting the eye of the infant for his amusement. Also, the toy 10 may be adjusted so that the play objects are within the infant's reach so that he may grab the individual objects or bat at them with his hand. By using the coiled rubber springs 38, the play objects when hit or grabbed will return to their original position when released or when they discontinue moving back and forth when hit. While the bell 40, mirror 42, and star 44 are shown, it should be appreciated that various types of play objects having different sizes, shapes, and colors may be used equally well for attracting the infant's eye and for his amusement.

Slidably mounted to the vertical arms 18 and 22 are adjustable clamps 46. The clamps 46 include a ring 48 slidably disposed around the vertical arms 18 and 22 and having a thumbscrew 50 therethrough for tightening the ring 48 to the sides of the arms 18 and 22. Attached to the sides of the ring 48 is an adhesive plate 52 having an adhesive surface for attaching to the sides of an infant seat, car seat, or the like.

Figure 2:
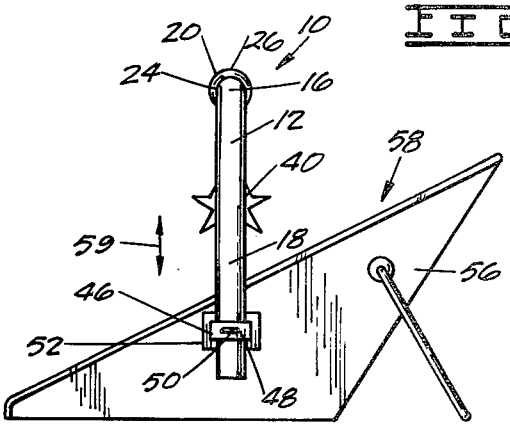
In FIG. 2, a side view of the infant toy is shown attached to an infant seat.

When it is desired to use the toy 10 with a car seat, infant seat, or the like, the end portions 28 and 30 of the tubes 12 and 14 are removed from the collars 32. The adjustable clamps 46 are then loosened on the arms 18 and 22 by unscrewing the thumbscrews 50. The adhesive plates 52 are then attached to sides 56 of an infant seat 58 shown in FIG. 2. The adjustable clamps 46 then receive the tubes 12 and 14 and secure the toy 10 in an upright vertical position above the infant in the seat 58. Should it be desired to adjust the play objects so that the infant can hit or grab the objects, the tubes 12 and 14 may be adjusted in height by raising and lowering the vertical arms 18 and 22 in the rings 48 and then held in place by tightening the thumbscrews 50. The height adjustment is indicated by arrow 59. In FIG. 2, a side view of the toy 10 is illustrated wherein the end portion 24 of the horizontal arm 16 can be seen received inside the inner diameter of the end portion 26 of the arm 20.

Figure 3:
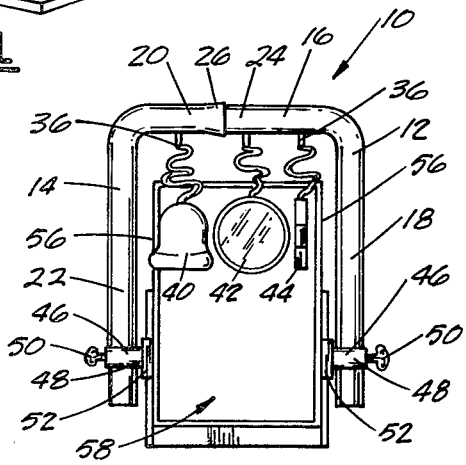
FIG. 3 is a front view of the infant toy attached to the infant seat.

In FIG. 3, a front view of the toy 10 is illustrated with the adjustable clamps 46 shown attached to the sides 56 of the infant seat 58. In this view the bell 40, mirror 42, and star 44 can be seen suspended above and in front of the seat 58.

Figure 4:
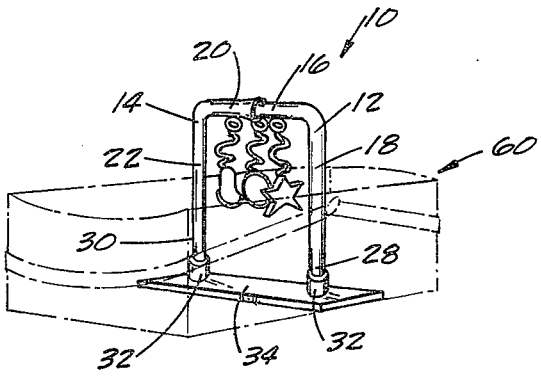
FIG. 4 is a perspective view of the infant toy disposed inside an infant bed.

In FIG. 4, the toy 10 is shown wherein the first and second tubes 12 and 14 have been removed from the adjustable clamps 46 which are normally left with the infant seat 58 so that the adjustable clamps 46 may be again used when the infant is returned to the seat 58 and the toy 10 is again attached to the seat 58. The toy 10 in FIG. 4 is shown with the flat angular base 34 disposed in the bottom of an infant bed 60. The ends 28 and 30 of the vertical arms 18 and 22 are received in a press fit in the collars 32 on top of the base 34. The infant can be placed on top of the flat base 32 with the play objects suspended above him or a blanket or mattress may be placed on top of the base 34 and between the tubes 12 and 14. While an infant bed is shown, it should be appreciated that the toy 10 as shown in FIG. 4 could also be used in a playpen, stroller, or any other flat surface used for placing the infant thereon.

Changes may be made in the construction or arrangement of the parts or elements of the embodiments as disclosed herein without departing from the spirit or scope of the invention as defined in the following claims.

We claim:

1. An infant toy for mounting on an infant seat or placing it in an infant bed, the infant toy comprising:

a first inverted "L"-shaped tube;

a second inverted "L"-shaped tube adjustably attached to said first tube;

a play object attached to the top of the first and second tubes and suspended therefrom, the play object attractable to the eye for amusing the infant; and attachment means for holding said first and second tubes in an upright position and securing the tubes to the infant seat or infant bed, said attachment means being a pair of adjustable clamps slideably mounted on said first and second tubes, said clamps having an adhesive plate mounted thereon, said adhesive plates used for said securing said first and second tubes.

2. The toy as described in claim 1 wherein said attachment means also comprises angularly shaped base having a pair of hollow collars mounted thereon, the collars receiving the ends of the first and second tubes in a press fit and holding the tubes in an upright position in the infant bed.

3. An infant toy for mounting on an infant seat or placing it in an infant bed, the infant toy comprising:

a first inverted "L"-shaped tube having a horizontal arm and an elongated vertical arm;

a second inverted "L"-shaped tube having a horizontal arm and an elongated vertical arm, the end of the horizontal arm of the first tube slidably received in the end of the horizontal arm of the second tube;

a plurality of play objects, each of the play objects attached to a coiled rubber spring, the end of the springs attached to the horizontal arms of the first and second tubes and suspended therefrom, the play objects attractable to the eye for amusing the infant; and attachment means for holding the vertical arms of the first and second tubes in an upright position and securing the tubes to the infant seat or infant bed.

4. The toy as described in claim 3 wherein said attachment means is a flat angularly shaped base having a pair of hollow collars mounted in the top thereof, the collars receiving the ends of the vertical arms of the first and second tubes in a press fit and holding the tubes in an upright position.

5. The toy as described in claim 3 wherein said attachment means is a pair of adjustable clamps, the clamps including a slidable ring disposed around the vertical arms of the first and second tubes, a thumbscrew through the side of the slidable ring for securing the ring to the vertical arm of the tubes, and an adhesive plate attached to the ring, the adhesive plate securing the vertical arms of the tubes to the sides of the infant seat in an upright position.

* * * * *